United States Patent [19]

McAnelly et al.

[11] Patent Number: 4,842,260

[45] Date of Patent: Jun. 27, 1989

[54] MODULAR COLLATING ASSEMBLY

[75] Inventors: Jan A. McAnelly, West Linn; Joseph Joiner, Portland, both of Oreg.

[73] Assignee: Continuous Graphics, Inc., Portland, Oreg.

[21] Appl. No.: 128,722

[22] Filed: Dec. 4, 1987

[51] Int. Cl.[4] ..... B65H 39/00

[52] U.S. Cl. ..... 270/52; 270/53; 270/40; 270/52.5

[58] Field of Search ..... 270/37, 40–44, 270/53, 52.5; 282/11.5 A; 493/60, 63, 64, 363, 365, 367, 370, 270, 324

[56] References Cited

U.S. PATENT DOCUMENTS

| | | | |
|---|---|---|---|
| 3,249,352 | 5/1966 | Wise . | |
| 3,475,249 | 10/1969 | Smith, Jr. | 156/253 |
| 3,727,908 | 4/1973 | Whitesell et al. | 270/53 |
| 4,114,869 | 9/1978 | Gladow et al. | 270/37 |
| 4,471,977 | 9/1984 | Stackhouse | 270/39 |
| 4,536,176 | 8/1985 | Gaspar | 493/365 |
| 4,601,693 | 7/1986 | Richey | 493/370 |

*Primary Examiner*—Robert E. Garrett
*Assistant Examiner*—Therese M. Newholm
*Attorney, Agent, or Firm*—Chernoff, Vilhauer, McClung & Stenzel

[57] ABSTRACT

An improved pin driven collator with a freely rotatable platen for crimping a plurality of single sheets into a continuous multiple copy forms is disclosed. The collator assembly comprises a modular assembly having a frame to fix a pin drive, rotary plunger and platen into preselected spatial alignment and to maintain such components in dynamic registry. The rotary plunger is fixed to a shaft which also carries a drive sprocket which is engaged by an endless pin chain loop of the pin drive. A pair of mirror image modular collating assemblies are supported and interconnected by a pair of shafts, a splined drive shaft and a stabilizing shaft. The modular assemblies may slide along the shafts to adjust for varying paper width without disturbing the spatial alignment of the components or their dynamic registry.

20 Claims, 3 Drawing Sheets

MODULAR COLLATING ASSEMBLY

BACKGROUND OF THE INVENTION

The present invention relates to an improved collator for crimping a plurality of continuous sheets into continuous multiple copy forms and more particularly, to a modular collating assembly having a freely rotatable platen.

Typically, continuous multiple copy forms are assembled from separate sheets having holes along both margins which are spaced so as to be compatible with standard pin drive equipment. For example, most computer printers have pin drives designed to accept paper with hole centers spaced one-half inch apart along both edges. In the use of such multiple copy forms it is essential that the holes of each forms layer be maintained in substantial alignment so as to properly engage the respective pin drives of printers or other equipment connected with multiple copy forms manufacture and use. A preferred method of securing the multiple copies of such forms in proper alignment is to provide a series of crimps to the edges of the multiple sheets while the sheets are held in alignment with each other. Each crimp serves to hold the multiple sheets together by displacing small segments of the sheets so as to form a sufficient entanglement of the displaced but unsevered segments to connect the sheets at the crimp site.

One problem which occurs when collating multiple copy forms is that the multiple separate sheets of continuous paper which make up the multiple copy forms are not always uniform themselves. This problem is especially prevalent in multiple copy carbonless forms because the various chemical treatments to which the various separate sheets are subjected may shrink or otherwise distort one sheet out of conformity with the others. When the separate sheets are crimped together into a multiple copy forms, this non-uniformity can cause stresses, even "bubbles", within the crimped multiple copy forms leading to subsequent problems when driving, folding or printing such forms.

Continuous multiple copy forms collators of the prior art, such as Smith, U.S. Pat. No. 3,475,249, Whitesell, U.S. Pat. No. 3,727,908, Gaspar, U.S. Pat. No. 4,536,176 and Richey U.S. Pat. No. 4,601,693, all use some type of pin drive having a plurality of pins to move the continuous multiple sheets through the collating machine and to maintain the sheets in alignment between a rotating crimping blade and an opposed driven platen. In all these devices it is necessary that the moving crimping blade, moving multiple sheets and moving platen surface all come into simultaneous engagement while moving at an identical linear speed so as to achieve the desired crimp pattern and to prevent misregistration or tearing of the multiple sheets. As discussed in Richey, variations of hole spacing and other irregularities in the paper inevitably occur, often resulting in a bubbling effect between the layers of the multiple copy form. This condition can cause misalignment of the sheets at the crimping site thereby resulting in permanent misalignment of the final multiple forms.

To achieve proper alignment at the crimping site, Richey employs a rotating cylindrical crimp blade holder having a plurality of pins about its circumference interspaced with a plurality of crimp blades. Thus, the crimp blade holder serves as both crimping element and pin drive element. To achieve proper alignment of the multiple sheets at the moment of crimping, Richey uses a pin forward of the crimp blade in the direction of rotation to align the sheets immediately prior to crimping, and another pin, rearward of the crimp blade to maintain alignment as the crimp blade exits the paper. (See Richey, FIGS. 9 and 10) Richey's crimp blade holder is used in cooperation with a driven cylindrical platen having annular grooves for receiving the crimp blades and having a plurality of holes for engagement with the pins. The multiple sheets pass between the two cylindrical bodies at the proper linear speed and with selected paper holes engaged in sequence by the pins.

Unfortunately, the devices described above present several disadvantages. Foremost among these disadvantages is the relatively complicated system of gears and shafts which are required to achieve an identical linear speed for the pin drive, platen, and crimp blade. Further, in Richey for example, it is necessary to disengage the crimp blade holder cylinder from the platen in order to thread new sheets, or to service damaged blades or pins. Finally, when inadvertent misalignment or misregistration between the driven crimp blade holder cylinder and the driven platen does occur, the pins may be broken off or other serious damage could be inflicted upon the apparatus.

SUMMARY OF THE INVENTION

The present invention is directed toward an improved multiple copy collator which allows the sheets to be relaxed while they are being crimped to reduce the stresses built into the multiple copy forms. The collating assembly of the present invention is modular so as to reduce problems associated with achieving and maintaining dynamic registration and positional alignment.

An exemplary collating assembly according to the present invention includes a pin drive for engaging the pinholes on one margin of several continuous sheets and aligning and moving the sheets within a reference plane, a platen arranged adjacent the sheets, and an opposed rotary plunger which cooperates with the platen to crimp the sheets together, the platen being freely rotatable.

The exemplary collating assembly is modular having a frame to fix the pin drive, rotary plunger, and platen into preselected spatial alignment and to maintain such components in dynamic registry.

Accordingly, it is a principal object of the present invention to provide an improved collator having a pair of modular collating assemblies.

It is another principal object to provide such a collating assembly which has a freely rotatable platen.

It is an associated object to provide such a collator which eliminates the need for a complicated system of gears and shafts interconnecting the collating assemblies associated with each margin of the continuous sheets.

It is a related object to provide a collator which eliminates or reduces stresses in the resulting continuous form.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
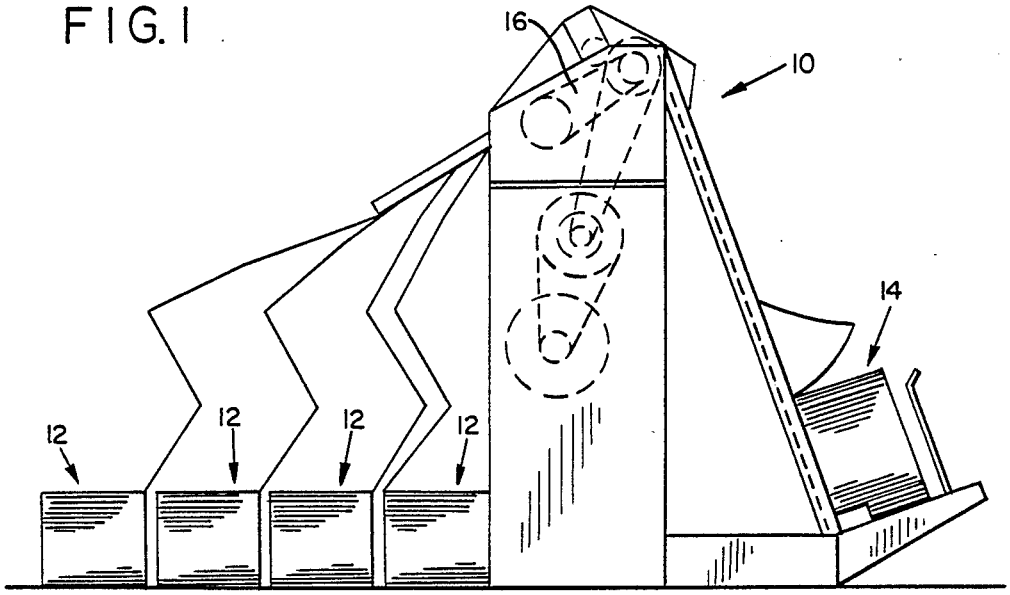
FIG. 1 is a side view of an exemplary machine incorporating the modular collating assemblies of the present invention.
Figure 2:
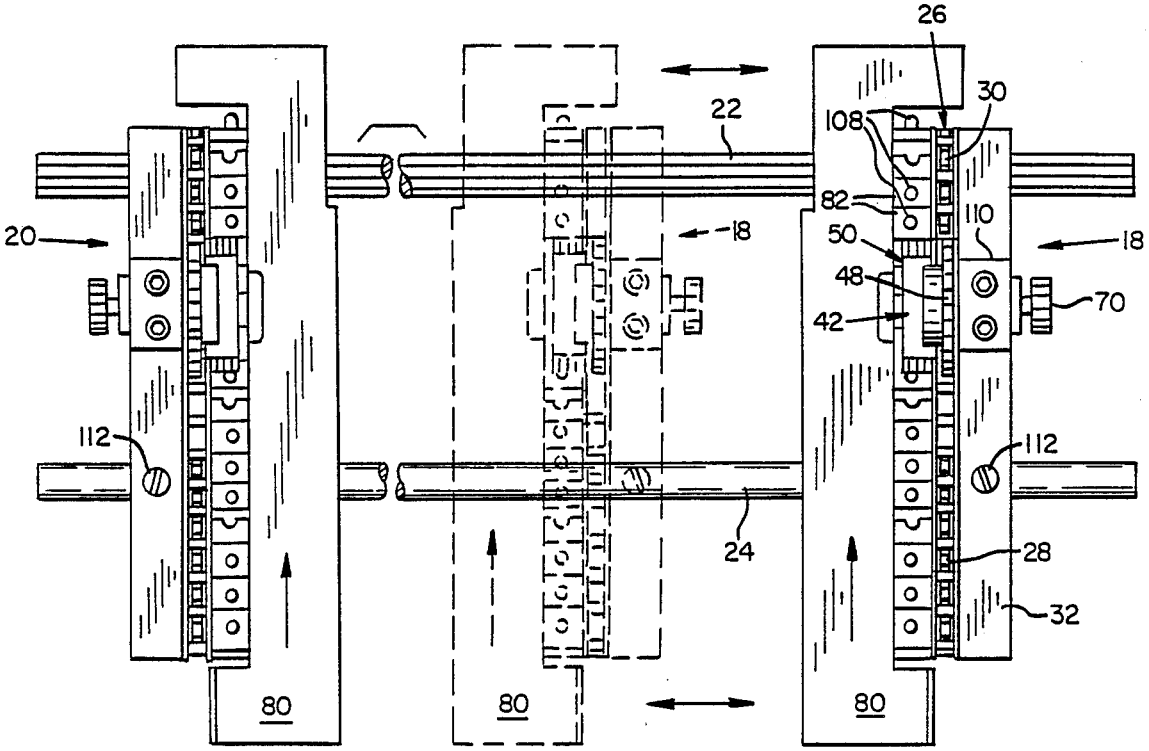
FIG. 2 is a top view of the machine of FIG. 1 showing two exemplary modular collating assemblies and illustrating how one modular assembly may be moved with respect to the other.

Referring to FIG. 1, a machine 10 for crimping a plurality of continuous sheets 12 having standard spaced holes along the margins thereof into continuous multiple forms 14 is shown. The machine 10 incorporates the improved collator 16 of the present invention. As shown in FIG. 2, the collator 16 is comprised of a pair of modular collating assemblies, 18, 20 which, as will be further explained herein, serve to feed and crimp the plurality of sheets 12 into continuous single multiple copy forms 14. The modular collating assemblies 18, 20 are constructed so as to be of a mirror image of the other, but are otherwise structurally identical. The collating assemblies 18, 20 are supported and interconnected by a splined drive shaft 22 and a stabilizing shaft 24 parallel to the splined drive shaft.

Figure 3:
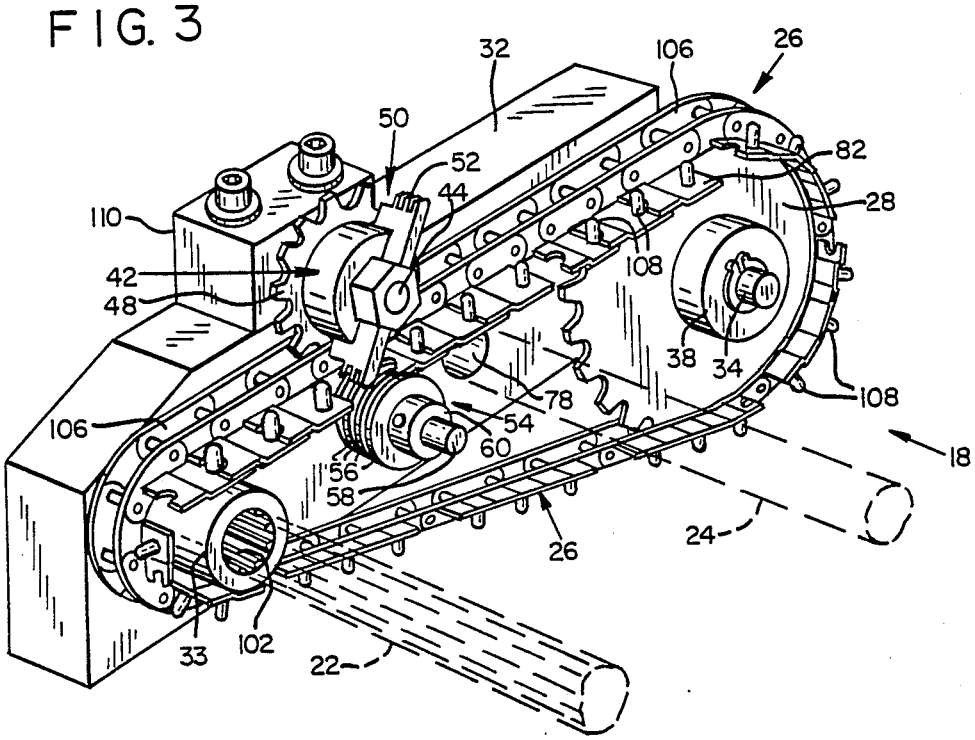
FIG. 3 is a front perspective view of an exemplary embodiment of a modular collating assembly constructed in accordance with the present invention.
Figure 4:
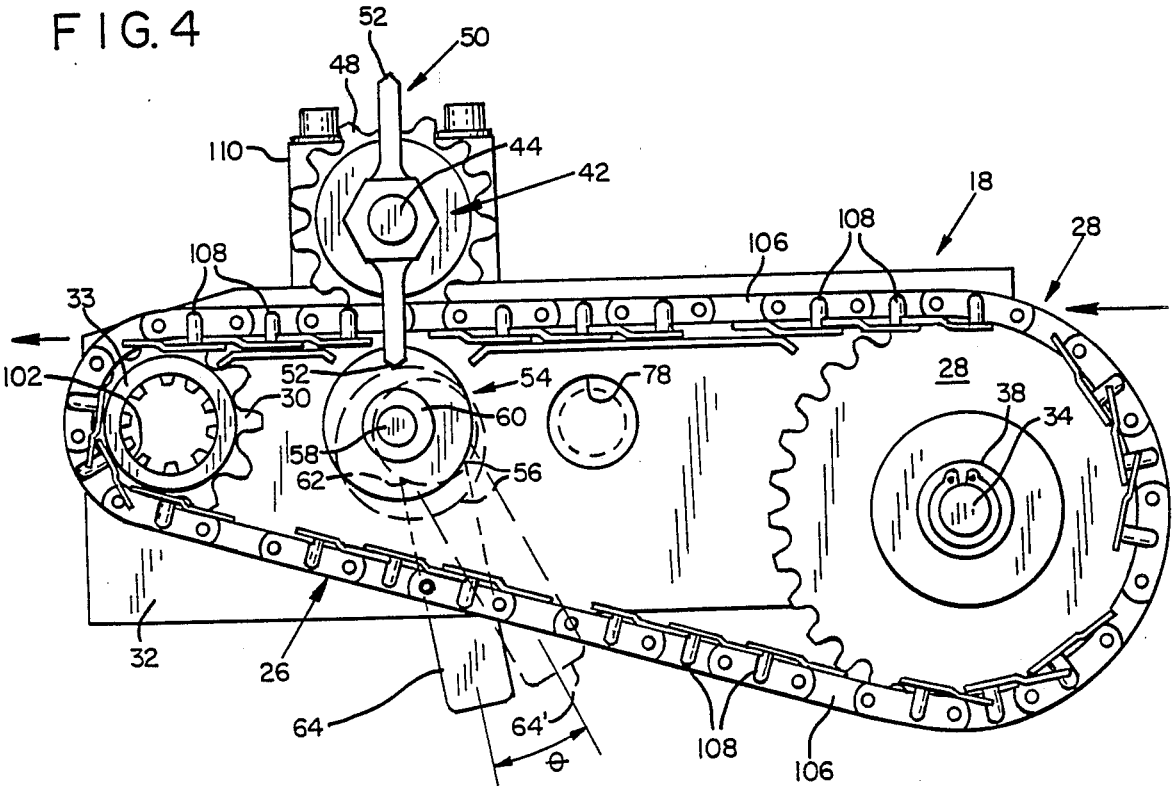
FIG. 4 is a front view of the collating assembly of FIG. 3.
Figure 5:
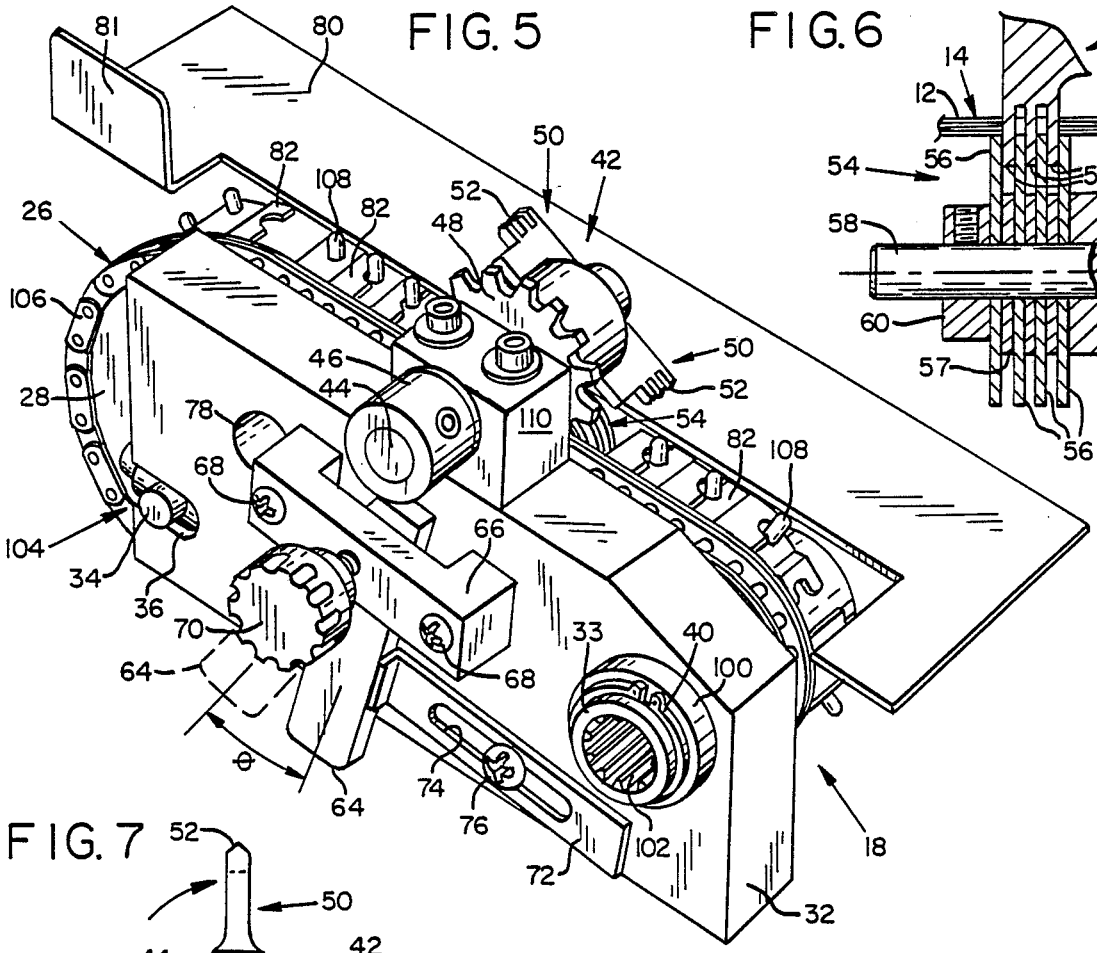
FIG. 5 is a rear perspective view of the collating assembly of FIG. 3.

Referring generally to FIGS. 3, 4 and 5, the modular collating assembly 18 includes a pin drive having an endless pin chain loop 26 trained over idler gear 28 and drive gear 30. Drive gear 30 includes an integral collar 33 extending through frame 32 and supported in the frame by a bushing 100 which permits the drive gear and collar to rotate with respect to the frame. The inner circumference of the collar includes a plurality of parallel grooves 102. Idler gear 28 is secured to frame 32 by means of a bushing 38 on a stationary shaft 34 to permit the idler gear to freely rotate with respect to the stationary shaft. The shaft 34 is secured in a U-shaped channel 36 in frame 32 which permits the idler gear to be moved toward or away from the drive gear in order to properly tension the pin chain without moving the splined drive shaft 22 or the drive gear 30.

As best seen in FIGS. 2–5, the pin chain 26 includes an endless loop of links 106 which engage the teeth of the drive sprocket 30 and idler sprocket 28. Some of the links include pin plates 82 having pins 108 projecting therefrom for engaging the pinholes on the margins of the continuous sheets. The pin plates extend out from their respective links in a direction substantially perpendicular to a plane defined by the pin chain loop. In the exemplary collating assembly shown in the drawings, every fourth link does not have a respective pin plate leaving gaps between groups of three pin plates.

Each modular collating assembly 18 further includes a rotary plunger 42 having a pair of opposed heads 50, each head including a plurality of spaced-apart teeth 52. The plunger is fixed to a shaft 44 which is rotatably secured to the frame 32 by a pillowblock bushing 110 attached to the frame. A drive sprocket 48 is also fixed to shaft 44 for rotation therewith. The shaft and drive sprocket of the rotary plunger is so positioned that the sprocket teeth engage the links of the pin chain.

Figure 6:
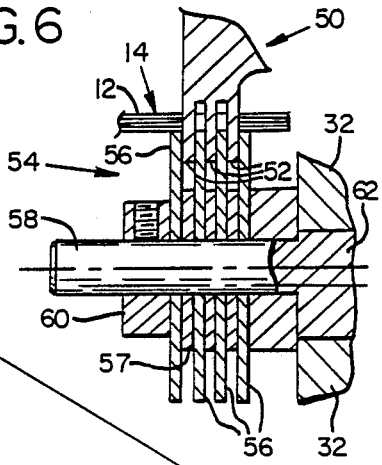
FIG. 6 is a partial sectional side view of the collating assembly of FIG. 3 showing engagement of the plunger head with the multiple sheets and platen.

Also connected to the frame 32 is a rotary platen 54 consisting of a plurality of alternating discs 56 and spacers 57, of substantially smaller diameter, as best seen in FIG. 6. The discs and spacers each rotate freely and independently on a non-rotating shaft 58 passing through a hole in each disc and spacer. The opposite end of shaft 58 is eccentrically mounted in a rotatable circular disc 62, shown in dashed lines in FIG. 4, which occupies a circular hole in frame 32. A lever 64 is connected to the disc 62 on the opposite side of frame 32 from the platen 54. A bracket 66 is positioned over the lever 64 and is joined by screws 68 to the frame 32. A threaded retaining knob 70 engages a threaded hole in bracket 66 and is positioned in perpendicular alignment over a facing surface of lever 64. The movement of lever 64 is constrained at one end by a clip 72 having an elongate aperture 74 through which a screw 76 secures the clip 72 to the frame 32.

Finally, a paper guide plate 80, as shown in FIG. 5, including a bracket, not shown, bolted to the frame 32 so as to position the top of the guide plate substantially within the plane of the upper pin plates 82, such plane hereinafter referred to as the paper plane or reference plane. A perpendicular flap 81 of the guide plate serves to align the margin of sheets 12 for engagement with the pins of the pin chain.

In typical operation, two oppositely facing modular collating assemblies 18, 20 would be adjustably mounted in a mirror image fashion to the splined drive shaft 22 and to the stabilizing shaft 24 of the machine 10 as shown in FIG. 2. The collating assemblies 18, 20 are spaced apart so as to correspond to the width of the continuous sheets 12, with collating assembly 18 engaging the pin holes on the right margin and the collating assembly 20 engaging the pin holes on the left margin of the sheets. The identical pin chains 26 of the respective collating assemblies 18, 20 are driven by a common power means operatively connected to the splined shaft which is respectively received in the collars 33 associated with the respective drive gear 30 of each collating assembly thereby transporting the sheets 12 uniformly through the collator 16. The splines on the splined shaft engage the grooves on the inner surface of the collar. The sheets 12 pass through the collator 16 along the reference plane defined by the guide plate 80 of each collator 18, 20 in the direction defined by the arrows in FIGS. 2 and 4.

Referring to the modular collating assembly shown in FIG. 4, the counterclockwise rotation of chain 26 rotates the plunger assembly 42 clockwise through interaction of the pin chain with the sprocket 48 associated with the rotary plunger. The plunger assembly is aligned above the platen 54 so that the teeth 52 of plunger heads 50 cooperatively engage the discs 56 of platen 54 as illustrated in FIG. 6 with the teeth of the plunger entering into the gaps between the discs maintained by the spacers 57. The degree of engagement of the teeth with the discs can be varied by pivoting lever 64, which rotates the eccentric mounting disc 62 raising or lowering the platen shaft 58 relative to the plunger assembly. The grouping of the pin plates 82 on the pin chain provides gaps which are in dynamic registry with the engagement of a plunger head 50 with the platen, the head of the plunger rotating down into the gap in the pin chain to crimp the sheets together while they are engaged by pins fore and aft of the gap. The platen 54 and plunger 42 are alligned on opposite sides of the continuous sheets as they move through the collator in the reference plane, with the platen slightly breaking the reference plane.

Figure 7:
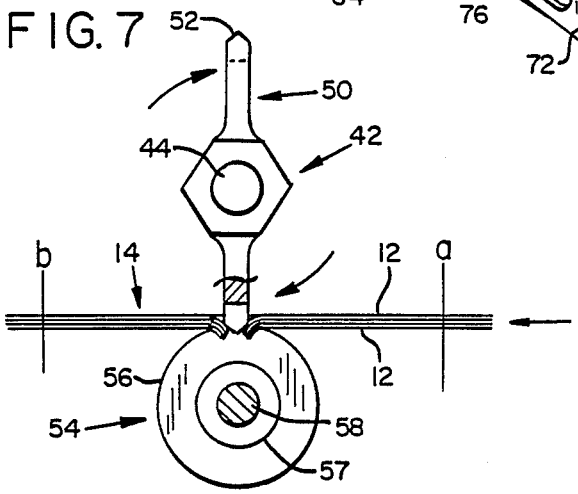
FIG. 7 is a partial sectional front view of the collating assembly of FIG. 3 showing engagement of the plunger head, multiple sheets and the freely rotatable platen in accordance with the present invention.

As shown in FIG. 7 a crimp is created in the margin of the sheets 12 as the teeth 52 of the plunger head 50 engages the sheets simultaneously with the discs 56 of platen 54 thereby displacing and entangling partially separated segments of sheets created therebetween.

Figure 8:
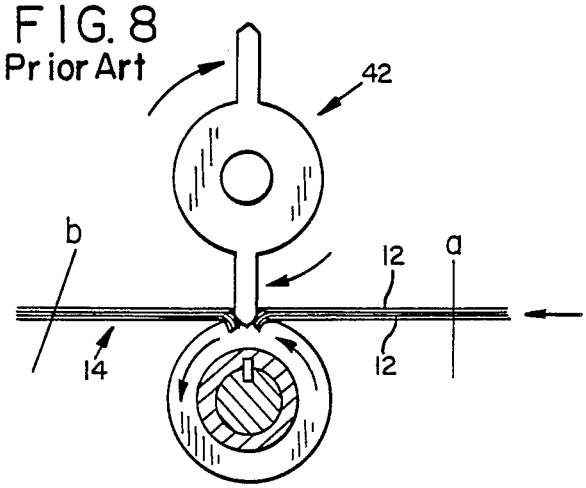
FIG. 8 Prior Art
FIG. 8 is a partial sectional front view of an hypothetical collator showing engagement of a plunger head, multiple sheets and a driven platen.

It is in this area that one of the particular advantages of applicant's collating assembly occurs. Referring to FIG. 8, the prior art collators discussed in the Background of the Invention portion of this application employ driven platens. In order for the collator to function properly, the circumference of the platen where it contacts the paper must be travelling at the same lineal speed as the paper. Otherwise stresses will be introduced between the multiple sheets. A driven platen, even rotating at the proper circumferential speed, can distort the alignment of the sheets.

Figure 9:
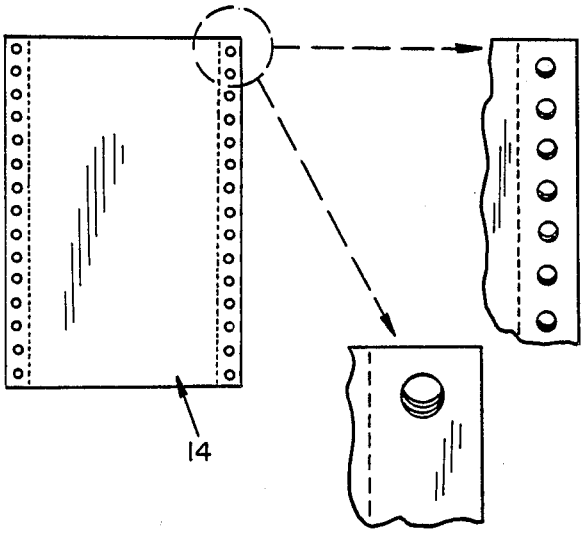
FIG. 9 is a depiction of the type of misalignment of a multiple coy form which can occur as a result of a driven platen.

As shown in FIG. 8 a hypothetical driven platen intersects the reference plane represented by the sheets of paper and is in physical contact with the bottom sheet of the multiple sheets which make up the forms. The frictional engagement of the driven platen with the bottom sheet has a tendency to advance the bottom sheet slightly ahead of the top sheet as illustrated by the reference lines a and b in FIG. 8. This phenomenon is thought to be particularly prevalent when the plunger is initially contacting the top sheet of the form, exerting a downward and forward force upon the top sheet and pinching the form against the driven platen which is exerting substantially only a forward force on the bottom sheet of the form. Thus, a driven platen can cause the result shown in FIG. 9, with the bottom sheet of the resulting multiple copy form advanced with respect to the top sheet.

Referring to FIG. 6, it will be understood that since the teeth of the plunger and the discs intermesh with each other, it is impossible to have all adjacent portions of the plunger and platen traveling at the exact same lineal speed. The lineal speed of a point on a rotating device is determined by the rpm of the rotating device and the distance that particular point is from the axis of rotation. The larger the radius of the point, the greater its lineal speed. Therefore, if the outer circumference of the platen is rotating at a lineal speed which is precisely equal to the lineal speed of the portion of the teeth which is immediately adjacent to the circumference of the platen, it follows that the tip of the teeth will be moving faster than the immediately adjacent portion of the disc, which has a smaller radius than the circumference of the disc.

Referring to FIG. 7, it will be further appreciated that the lineal speed of the teeth 52 in the reference plane only equals the lineal speed of sheets 12 when the head 50 of the rotary plunger is exactly perpendicular to the reference plane. Therefore, the teeth 50 enter and exit the top sheet at a lineal speed slightly less than the lineal speed of the sheets in their direction of travel within the reference plane. The potential for misalignment of the top sheets due to this effect is minimized by the freely rotatable platen which does not resist the small velocity differences created by the entering and exiting plunger head.

Referring again to FIG. 7, the non-driven, freely rotatable platen of the present invention permits the paper to be relaxed, rather than stressed, during the crimping action. The freely rotatable platen 54 will rotate along with the paper passing over it and will adjust for slight increases or decreases in the paper speed caused by action of the rotary plunger. The top and bottom sheets will stay in alignment with respect to each other as shown by reference lines a and b.

Other particular advantages of the present invention relate to the modular construction of the collating assemblies including the frame 32 which assures that the components of the assemblies remain in proper spatial alignment and dynamic registry with each other. In this respect, the freely rotatable platen is important in that it does not need to be driven at the appropriate speed thereby eliminating all the gears and drive shafts used by the prior art to achieve proper lineal speed of the platen. A freely rotatable platen also makes it very easy to disengage the platen from the paper plane so that the plunger does not pierce the sheets. Referring to the collator shown in FIG. 2, one of the platens may be disengaged in order to crimp a single margin of the forms. As illustrated in FIG. 4, the platen 54 can be raised or lowered by pivotal movement over $\theta$ degrees between the positions of lever 64 and lever 64'. Movement of the lever rotates disc 62 within the frame 32, which rotation changes the distance of eccentrically mounted shaft 58 relative to the rotary plunger 50. Nonengagement, or the degree of engagement of the plunger head 50 with the platen 54, once selected, can be held by tightening the retaining knob 70, best seen in FIG. 5, against the facing surface of lever 64.

As mentioned above, the modular collating assembly of the present invention keeps the components in proper spatial alignment and in proper dynamic registry, unaffected by lateral adjustment of the collating assembles with respect to each other. Once the pin chain and rotary plunger are set up so that the plunger rotates into the gap between the pin plates, they will remain spatially aligned and dynamically registered since the pin plates 82 which define the gap are fixed to the pin chain 26 which operatively engages the sprocket 48, which, in turn, is fixed for rotation on the same shaft as the rotary plunger.

This arrangement makes it quite simple to laterally adjust the collating assemblies with respect to each other by loosening the locking screw 112 and sliding the modular collating assembly along the splined shaft 22 and stabilizing shaft 24. From the foregoing comments it will be appreciated that such adjustment will not put either of the collating assemblies out of spatial alignment or dynamic registry.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An apparatus for collating a plurality of continuous sheets of the type having pinholes along a margin thereof into continuous multiple copy forms, said apparatus comprising:

(a) pin drive means having pins mounted thereon for engaging said pinholes and for aligning and moving said sheets substantially within a reference plane;

(b) a rotatable platen arranged adjacent to said sheets and located substantially on one side of said reference plane;

(c) a rotary plunger means for cooperating with said platen to crimp said continuous sheets into said multiple copy forms, said plunger means arranged adjacent to said sheets and substantially opposed to said platen on the opposite side of said reference plane; and (d) said platen being freely rotatable.

2. The apparatus of claim 1 wherein said pin drive means includes a pin chain loop.

3. The apparatus of claim 2 wherein said rotary plunger means is driven by a sprocket engaged with said pin chain loop.

4. The apparatus of claim 1 wherein the head of said plunger means includes a plurality of spaced apart teeth, said platen including of a plurality of adjacent discs spaced apart so as to receive said teeth between said adjacent discs.

5. The apparatus of claim 4 wherein each of said discs is independently and freely rotatable.

6. The apparatus of claim 1, including a plunger drive assembly having a drive sprocket with a plurality of teeth, said plunger and said drive sprocket both mounted on a common shaft for rotation therewith.

7. The apparatus of claim 6 wherein said pin drive means includes an endless pin chain loop having a plurality of links, said drive sprocket operatively engaging said pin chain so that said teeth of said drive sprocket engage said links of said pin chain loop to alternatively drive said pin chain or be driven by said pin chain.

8. The apparatus of claim 1, including adjustment means for selectively moving said platen toward or away from said reference plane so as to selectively crimp said margin of said forms.

9. The apparatus of claim 1 wherein said pin drive means, rotatable platen, and rotary plunger comprise a first collating assembly adapted to engage, align, drive and periodically crimp one margin of said continuous sheets within said reference plane, said apparatus including a second collating assembly, substantially identical to said first collating assembly, substantially opposed to said first collating assembly, positioned to engage, align, drive and periodically crimp the other margin of said continuous sheets within said reference plane.

10. The apparatus of claim 9, including a common power means for simultaneously operating said first and second collating assemblies.

11. The apparatus of claim 10 wherein said first and second collating assemblies are operatively connected by a single driven shaft operatively associated with said common power means.

12. The apparatus of claim 11 including a non-driven, stabilizing shaft, parallel to said driven shaft, interconnecting said first and second collating assemblies.

13. The apparatus of claim 12 wherein said first and second collating assemblies include means for permitting said one of said collating assemblies to be selectively moved as a unit toward or away from said other collating assembly by sliding said collating assembly along said driven shaft and stabilizing shaft.

14. An assembly for collating a plurality of continuous sheets of the type having pinholes along the margins thereof into continuous multiple copy forms, said assembly comprising:

(a) pin drive means including pins for engaging said pinholes and for aligning and moving said sheets substantially within a reference plane;

(b) a rotatable platen arranged adjacent to said sheets and located substantially on one side of said reference plane;

(c) rotary plunger means for cooperating with said platen to crimp said continuous sheets into said multiple copy forms, said rotary plunger means arranged adjacent to said sheets and substantially opposed to said platen on the opposite side of said reference plane;

(d) frame means for positioning and maintaining said pin drive means, said rotary plunger means and said rotatable platen into a modular assembly of preselected spatial alignment; and (e) said frame means also serving as means for moving said modular assembly without changing the cooperative spatial alignment of said pin drive means, platen, and plunger means with respect to each other.

15. The assembly of claim 14 wherein said pin drive means includes a pin chain loop, said frame means including means for positioning said pin chain loop in a chain lane perpendicular to said reference plane with a segment of said pin chain loop in said reference plane.

16. The assembly of claim 14 wherein said rotary plunger means is driven by a sprocket, said frame means including means for positioning said sprocket in said chain plane and in engagement with said pin chain loop.

17. The assembly of claim 14 wherein said platen includes a plurality of adjacent discs, said frame means including means for positioning said discs parallel to and spaced apart from said chain plane.

18. The assembly of claim 14 wherein said frame means includes means for positioning said plunger means substantially coplanar with said discs and in a fixed position with respect to said reference plane.

19. An assembly for collating a plurality of continuous sheets of the type having pinholes along the margins thereof into continuous multiple copy forms, said assembly comprising:

(a) pin drive means including pins for engaging said pinholes and for aligning and moving said sheets substantially within a reference plane;

(b) a rotatable platen arranged adjacent to said sheets and located substantially on one side of said reference plane;

(c) rotary plunger means for cooperating with said platen to crimp said continuous sheets into said multiple copy forms, said rotary plunger means arranged adjacent to said sheets and substantially opposed to said platen on the opposite side of said reference plane;

(d) frame means for positioning and maintaining said pin drive means, said rotary plunger means and said rotatable platen into a modular assembly of preselected spatial alignment;

(e) said modular assembly including means for maintaining said pin drive means in dynamic registry with said rotary plunger means; and (f) said frame means also serving as means for moving said modular assembly without changing the dynamic registry between said pin drive means and said rotary plunger means.

20. A collating machine for collating a plurality of continuous sheets of the type having pinholes along the margins thereof into continuous multiple copy forms, said machine comprising:

(a) pin drive means including pins for engaging said pinholes and for aligning and moving said sheets substantially within a reference plane;

(b) a rotatable platen arranged adjacent to said sheets and located substantially on one side of said reference plane;

(c) rotary plunger means for cooperating with said platen to crimp said continuous sheets into said multiple copy forms, said rotary plunger means arranged adjacent to said sheets and substantially opposed to said platen on the opposite side of said reference plane;

(d) frame means for positioning and maintaining said pin drive means, said rotary plunger means and said rotatable platen into a modular assembly of preselected spatial alignment; and (e) said pin drive means, platen, plunger, and frame means comprising a first collating assembly for engaging one margin of said continuous sheets, said collating machine including a second collating assembly, substantially identical to said first collating assembly and substantially opposed to said first collating assembly, positioned to engage the other margin of said continuous sheets; and (f) at least one of said first and second collating assemblies including independent adjustment means for adjusting the cooperation of said respective plunger and platen without affecting the cooperation of said plunger and platen associated with said other collating assembly.

* * * * *